US008390545B2

(12) United States Patent
Van Den Biggelaar et al.

(10) Patent No.: US 8,390,545 B2
(45) Date of Patent: Mar. 5, 2013

(54) RESET CIRCUIT FOR DISPLAY DEVICES

(75) Inventors: Theodorus Johannes Pterus Van Den Biggelaar, Eindhoven (NL); Roy Van Dijk, Eindhoven (NL)

(73) Assignee: Samsung LCD Netherlands R&D Center B.V., Eindhoven (NL)

( * ) Notice: Subject to any disclaimer, the term of this patent is extended or adjusted under 35 U.S.C. 154(b) by 827 days.

(21) Appl. No.: 12/091,175

(22) PCT Filed: Oct. 19, 2006

(86) PCT No.: PCT/IB2006/053852

§ 371 (c)(1),
(2), (4) Date: Apr. 23, 2008

(87) PCT Pub. No.: WO2007/049196

PCT Pub. Date: May 3, 2007

(65) Prior Publication Data

US 2008/0224970 A1 Sep. 18, 2008

(30) Foreign Application Priority Data

Oct. 25, 2005 (EP) ..... 05109951

(51) Int. Cl.
*G09G 3/34* (2006.01)

(52) U.S. Cl. ..... 345/84; 345/107; 345/204

(58) Field of Classification Search ..... 345/84–111, 345/204–215, 690–699
See application file for complete search history.

(56) References Cited

U.S. PATENT DOCUMENTS

| | | | | |
|---|---|---|---|---|
| 5,796,380 | A * | 8/1998 | Kurematsu | 345/96 |
| 6,201,521 | B1 | 3/2001 | Doherty | |
| 7,518,577 | B2 * | 4/2009 | Akimoto et al. | 345/76 |
| 7,592,980 | B2 * | 9/2009 | Yamazaki et al. | 345/76 |
| 2001/0011978 | A1 * | 8/2001 | Doherty et al. | 345/84 |
| 2003/0057895 | A1 * | 3/2003 | Kimura | 315/370 |
| 2003/0067424 | A1 * | 4/2003 | Akimoto et al. | 345/55 |
| 2003/0103021 | A1 * | 6/2003 | Young et al. | 345/76 |
| 2003/0197472 | A1 | 10/2003 | Kanauchi et al. | |
| 2005/0168434 | A1 * | 8/2005 | Wang-Yang | 345/103 |
| 2005/0168490 | A1 * | 8/2005 | Takahara | 345/690 |
| 2005/0180083 | A1 | 8/2005 | Takahara et al. | |
| 2005/0212787 | A1 * | 9/2005 | Noguchi et al. | 345/204 |
| 2006/0012549 | A1 * | 1/2006 | Ikeda | 345/76 |
| 2006/0284894 | A1 * | 12/2006 | Johnson et al. | 345/690 |
| 2006/0290651 | A1 * | 12/2006 | Verhaegh et al. | 345/107 |

(Continued)

FOREIGN PATENT DOCUMENTS

| | | | |
|---|---|---|---|
| EP | 1091342 | A2 | 4/2001 |
| EP | 1441573 | A2 | 7/2004 |
| WO | WO2004077124 | A1 | 9/2004 |
| WO | WO 2005036517 | A1 * | 4/2005 |
| WO | WO2005036517 | A1 | 4/2005 |

*Primary Examiner* — Lun-Yi Lao
*Assistant Examiner* — Gene W Lee
(74) *Attorney, Agent, or Firm* — H.C. Park & Associates, PLC

(57) ABSTRACT

The present invention relates to an active matrix display device, more particularly an electrowetting display device, comprising at least two rows of pixels and being provided with selection wires (RW) and data wires (COL) for addressing of the pixels. The pixels in each row are arranged with a respective connection (CW) to a common reset (RST) wire that is arranged to transmit a reset signal. The respective connection (CW) is arranged to be interconnected with the data wire (COL) of the pixel when the pixel is addressed. Further, the respective connection (CW) is arranged with a signal blocking element (D) for preventing a data signal of the pixel from propagating via the reset wire (RST) to pixels in the same row.

10 Claims, 4 Drawing Sheets

U.S. PATENT DOCUMENTS

2007/0075941 A1* 4/2007 Zhou et al. ..... 345/84
2007/0075945 A1* 4/2007 Shen et al. ..... 345/87
2007/0176176 A1* 8/2007 Yamazaki et al. ..... 257/59
2010/0231566 A1* 9/2010 Feenstra et al. ..... 345/211

* cited by examiner

RESET CIRCUIT FOR DISPLAY DEVICES

FIELD OF THE INVENTION

The present invention relates to an active matrix display device, more particularly an electrowetting display device, comprising at least two rows of pixels and being provided with selection wires and data wires for addressing of the pixels.

BACKGROUND OF THE INVENTION

Electrowetting displays are becoming attractive to an ever increasing extent, mainly because of a combination of high brightness, a high contrast ratio, a large viewing angle and a fast switching speed. These properties make electrowetting displays suitable for video applications. Furthermore, the power consumption of electrowetting displays is relatively low, because electrowetting displays use the principle of a reflective display device, i.e. electrowetting displays do not require front or backlight.

An electrowetting display typically comprises a closed electrowetting cell, a polar and non-polar liquid, such as water and a colored oil, having different optical properties and being contained in the cell, a number of electrodes for controlling the liquids contained in the cell, a front layer and a rear reflective layer. The liquids, which are immiscible, may be displaced by means of applying voltages to the electrodes. In an equilibrium-state (in which no voltages are applied to the electrodes) the polar and non-polar liquids are naturally layered in the closed cell, whereby a thin film is created. In this state, a colored off-state, the film covers the reflective area and the cell or pixel appears dark or black. By applying a voltage across the electrodes, the layered off-state is no longer energetically favorable and the cell or pixel may lower its energy by contracting the polar liquid. As a result the non-polar liquid is displaced and the underlying reflective or white surface is exposed. Consequently, in this state, a white on-state, the cell or pixel appears white or bright. The interaction between electrostatic and capillary forces determines how far the non-polar liquid is displaced to the side. In this manner, the optical properties of the layered composition may be adjusted such that intermediate color states, i.e. states lying between the colored off-state and the white on-state, are achieved.

Patent application publication WO 2005/036517 A1 discloses methods of driving devices for optical switches, in particular displays based on the principle of electrowetting. In WO 2005/036517 A1, there are disclosed optical switches comprising a first fluid and a second fluid immiscible with each other within a space between a first transparent plate and a second support plate, the second fluid being electro-conductive or polar. A method of driving the display by means of a reset pulse is disclosed, which brings the pixels of the display device into one of their extreme states (i.e. on or off). When driving an electrowetting display device of this type, each row must accordingly be selected twice each frame. A first selection signal is resetting the pixels and a second selection signal is writing data to the pixels. Even though the resetting of the pixels improves grey scale rendering, the method has the disadvantage of making the frame time or addressing time unnecessarily long.

SUMMARY OF THE INVENTION

An object of the present invention is to enable a decrease in frame time for a display device.

This object is met by the device as set forth in the appended independent claim. Specific embodiments are defined by the dependent claims.

According to an aspect of the invention, there is provided an active matrix display device comprising at least two rows of pixels and being provided with selection wires and data wires for addressing of the pixels. The pixels in each row are arranged with a respective connection to a common reset wire that is arranged to transmit a reset signal. The respective connection is arranged to be interconnected with the data wire of the pixel when the pixel is addressed. Further, the respective connection is arranged with a signal blocking element for preventing a data signal of the pixel from propagating via the reset wire to pixels in the same row. The pixels in a row are connected to a common reset wire via a respective connection, i.e. there is one connection or connection wire (and one signal blocking element) for each pixel.

A basic idea of the present invention is to reset a pixel of a display device by means of a reset signal propagating along a separate reset wire, whereby the number of selection signals per frame may be decreased. Typically, at least one row of pixels is reset with the same reset signal. The separate reset wire enables resetting of the pixel without having to send a dedicated selection signal and a dedicated data signal. Consequently, the pixel may be reset independently of the selection signals, i.e. the reset signal is transmittable independently of the selection signal. For example, while one pixel is being written another pixel may be reset or, as will be described in embodiments of the invention, one row of pixels is written while another row is reset. The reset wire and the data wire of the pixel are interconnected when the pixel is addressed and signals propagating along these wires may change the state of the pixel. The reset wire of a pixel is provided with a signal blocking element, which has as an effect that more than one pixel, e.g. a complete row of pixels, can be connected to the same reset wire. Thus, when a data signal is transferred along a data wire, the signal blocking element prevents the data signal from propagating along the reset wire to further pixels in the same row. As a consequence, the signal blocking element prevents undesired changes of the state of other pixels connected via their respective connection to the same reset wire.

In an embodiment of the invention, the reset wire is connected to the selection wire of another pixel. As a result, the reset signal is derived from the selection signal of another pixel. Thus, a selection signal may be sent as a reset signal to other pixels (typically to each pixel in the selected row). In this embodiment, the device according to the invention uses one selection signal for writing some pixels (e.g. a row of pixels) and simultaneously resetting some other pixels (e.g. another row of pixels), whereby the number of selection signals, in each frame, is decreased. Additionally, the reset wire may be connected, via connection wires, to pixels in the same row and, similarly as above, use the selection signal of another pixel row as the source of the reset signal. The row of pixels, to which the reset wire may connected, may be selected as current row plus the number of rows given by the integer resulting from dividing the reset time by the row selection time (counting any fractional part as a full integer). In this manner, the frame rate may be decreased by a factor of two. A man skilled in the art is free to select any number of rows between the current row and the row to which the reset wire is connected that is found suitable for any application.

However, it is to be noted that the time from reset signal to selection signal, preferably, should be greater than or equal to the reset time.

It should further be noted that updating of a display conventionally is made one row at a time from top to bottom of the display, and that the pixel resetting described herein consequently is made on a row-by-row basis. However, other pixel groupings are possible. It is for instance possible to reset pixels on a column-by-column basis, if desired. Further, it is possible to start addressing at, for instance, row 5, row 15, row 30, row 20, etc., until every row has been addressed.

In another embodiment of the invention, there is provided a display device having separate driving means for the reset wires. Thus, the reset wire is connected to an additional driver. Further, the rows of a display device may be arranged in groups of rows, where each group is connected to a respective driver. A man skilled in the art may envisage many ways of grouping the reset wires, depending on the application. Advantageously, this embodiment enables the implementation of several driving methods with flexible reset timing without reconstruction of the hardware configuration of the display device. This may be achieved by means of a small number of additional drivers, preferably additional row drivers.

Moreover, the display device may be an electrowetting display.

Further features of, and advantages with, the present invention will become apparent when studying the appended claims and the following description. Those skilled in the art realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

The various aspects of the invention, including its particular features and advantages, will be readily understood from the following detailed description and the accompanying drawings, in which.

DETAILED DESCRIPTION OF THE INVENTION

Figure 1A:
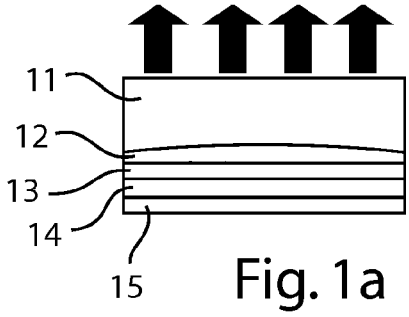
FIG. 1*a* shows a side view of an electrowetting display pixel in an off-state.

In FIG. 1*a*, there is shown an electrowetting cell comprising water 11, colored oil 12, a hydrophobic insulator 13, a transparent electrode 14 and a white substrate 15. There is no voltage applied to the cell, i.e. the pixel is in an off-state and consequently, the oil forms a colored homogeneous film. The black arrows indicate that the pixel appears dark.

Figure 1B:
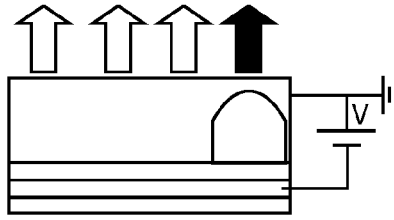
FIG. 1*b* shows a side view of an electrowetting display pixel in an on-state.

FIG. 1*b* shows the same cell as in FIG. 1*a*, but there is a DC-voltage V applied to the cell, i.e. the pixel is in an on-state and consequently, the oil film is contracted. The white arrows indicate that the pixel appears white (or bright).

Figure 2:
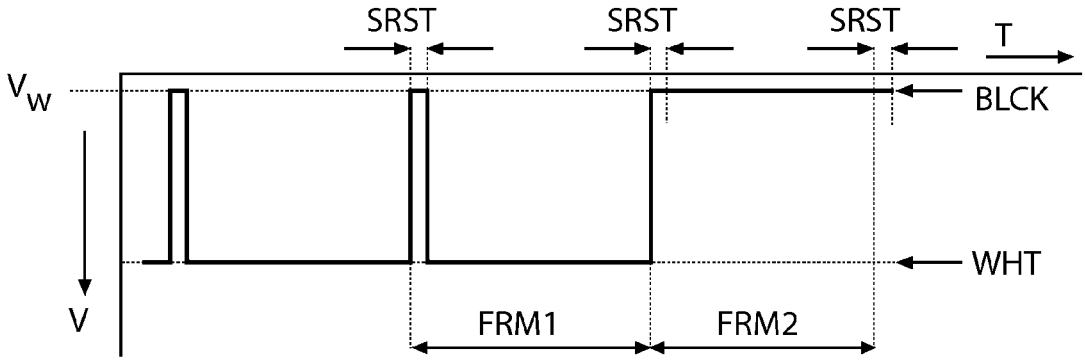
FIG. 2 shows two frames of an addressing signal, wherein a first frame sets the pixel in a white state and a second frame sets the pixel in a black state.
Figure 3:
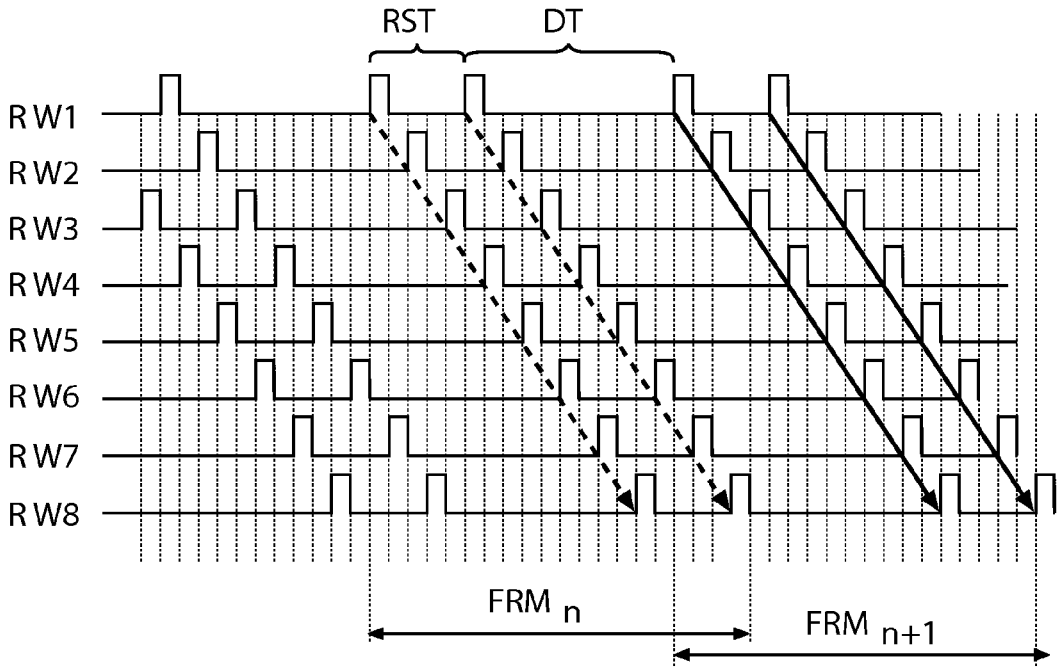
FIG. 3 shows a timing diagram of row selection signals.

Referring to FIG. 2, there is demonstrated how an addressing signal with a reset pulse may be timed with the frames FRM. The arrow T refers to time scale and the arrow V refers to the voltage over the pixel, where the voltage level $V_w$ is the level of the off-state. In the off-state, the pixel appears black BLCK and in the on-state the pixel appears white WHT. In this example, each frame begins with a stability reset pulse (SRST), whereby charging effects are reduced. Frame one FRM1 shows a white WHT state of the pixel. Frame two FRM2 shows the black BLCK off-state of the pixel In general, a display device according to prior art comprising an active matrix substrate may be addressed using column and row drivers. The column drivers set the voltage levels of the pixels and the row drivers select (or activate) a specific row, such that the voltage levels of the column drivers set the selected pixels in the desired state. When writing data to a pixel of the display, the row of the pixel must be selected and an appropriate voltage level must be applied to the pixel column driver, in order for the pixel to be selected and written in accordance with the voltage level applied to the column driver. This addressing technique is usually known as matrix addressing. For an electrowetting display that is mounted on an active matrix backplane, the timing and waveform for the row selection signals are given in FIG. 3. In FIG. 3, there are eight rows (RW 1 through RW 8). In RW 1 the reset RST and the data DT signals are indicated. It is to be noted that there may be an overlap between frames. As shown, frame FRM n is overlapping frame FRM n+1.

Figure 4:
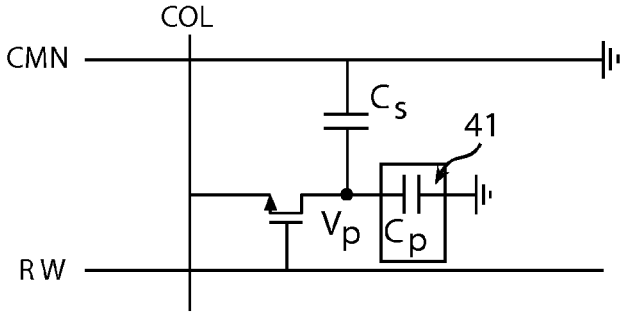
FIG. 4 shows a schematic view of a pixel according to prior art.

In FIG. 4, there is shown a schematic view of a pixel according to prior art. An active matrix (AM) display device is driven by the active switching elements, which in this example comprise thin film transistors (TFTs). The AM display device comprises a matrix of picture elements. A picture element may be activated or selected by means of transmitting a selection or row signal along a selection or row wire RW and transmitting a data or column signal along a data or column wire COL. A row driver consecutively selects the row wire RW, while a column driver provides data signals via the column wire COL to the pixel associated with the selected row wire. In FIG. 4, a pixel is illustrated by means of a capacitor 41. CMN denotes electrical ground. The pixel 41 is further connected to a capacitor $C_s$ for storage.

Figure 5:
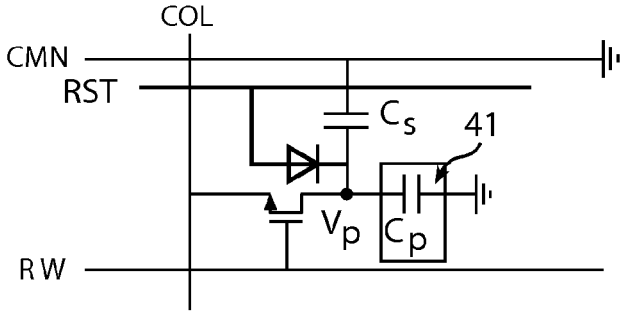
FIG. 5 shows a schematic view of a pixel according to an embodiment the invention.

In FIG. 5, a pixel 41 of the display device according to an embodiment of the invention is illustrated. An AM display device is driven by the active switching elements, which in this example comprise TFTs. The AM display device comprises a matrix of picture elements, which may be controlled as described above. CMN denotes electrical ground. The pixel 41 is further connected to a capacitor for storage $C_s$. Additionally, the pixel 41 is connected to a reset wire RST via a diode. The reset wire RST is used for transmitting a reset signal. The diode prevents potential transfer of the data signal to other columns via the reset wire RST.

Figure 6:
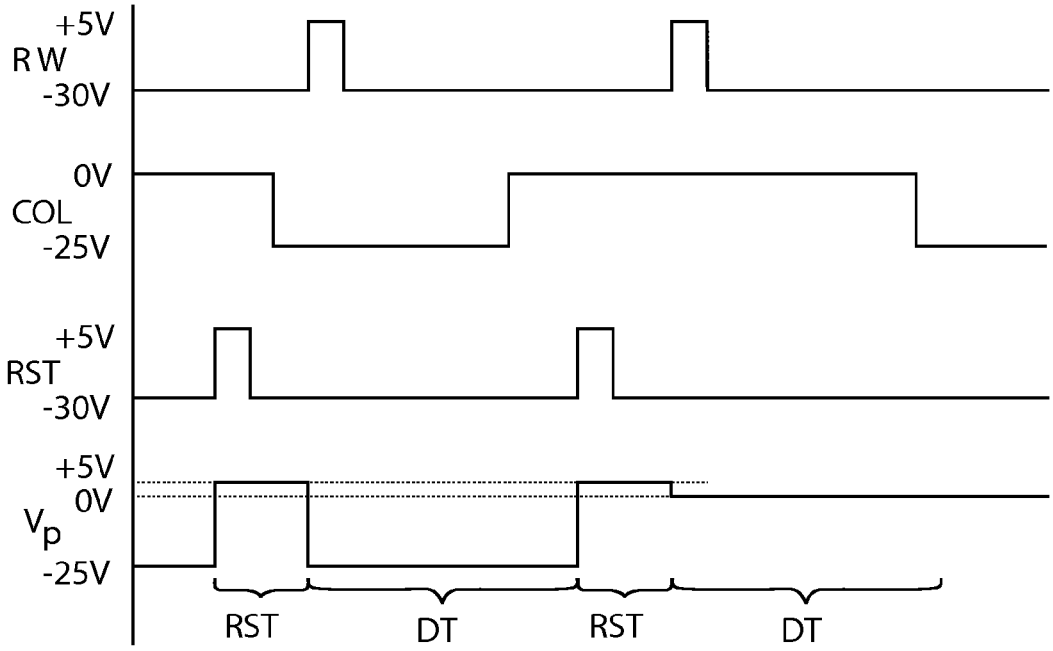
FIG. 6 shows signals and wave forms of a pixel, comprised in the display device according to an embodiment of the invention.

FIG. 6 shows signals and waveforms of the active matrix substrate for a pixel of the display device according to an embodiment of the invention. RW, COL, RST, DT and Vp denote row, column, reset, data and pixel voltage, respectively. Two reset signals and two data signals are illustrated. First, when the RST signal is activated (i.e. set to +5V), and the pixel capacitor will be charged to a pixel voltage Vp of about 5V until the RW signal is activated (i.e. set to +5V). The active RW signal opens the transistor and the COL signal level (−25V) is applied to the pixel capacitor, which is charged and sets the pixel voltage Vp to about −25V. Second, when the RST signal again is activated, the pixel voltage Vp rises to about +5V. When the RW signal is activated, the transistor opens and the COL signal level (0V) sets the pixel voltage Vp to about 0V.

Figure 7:
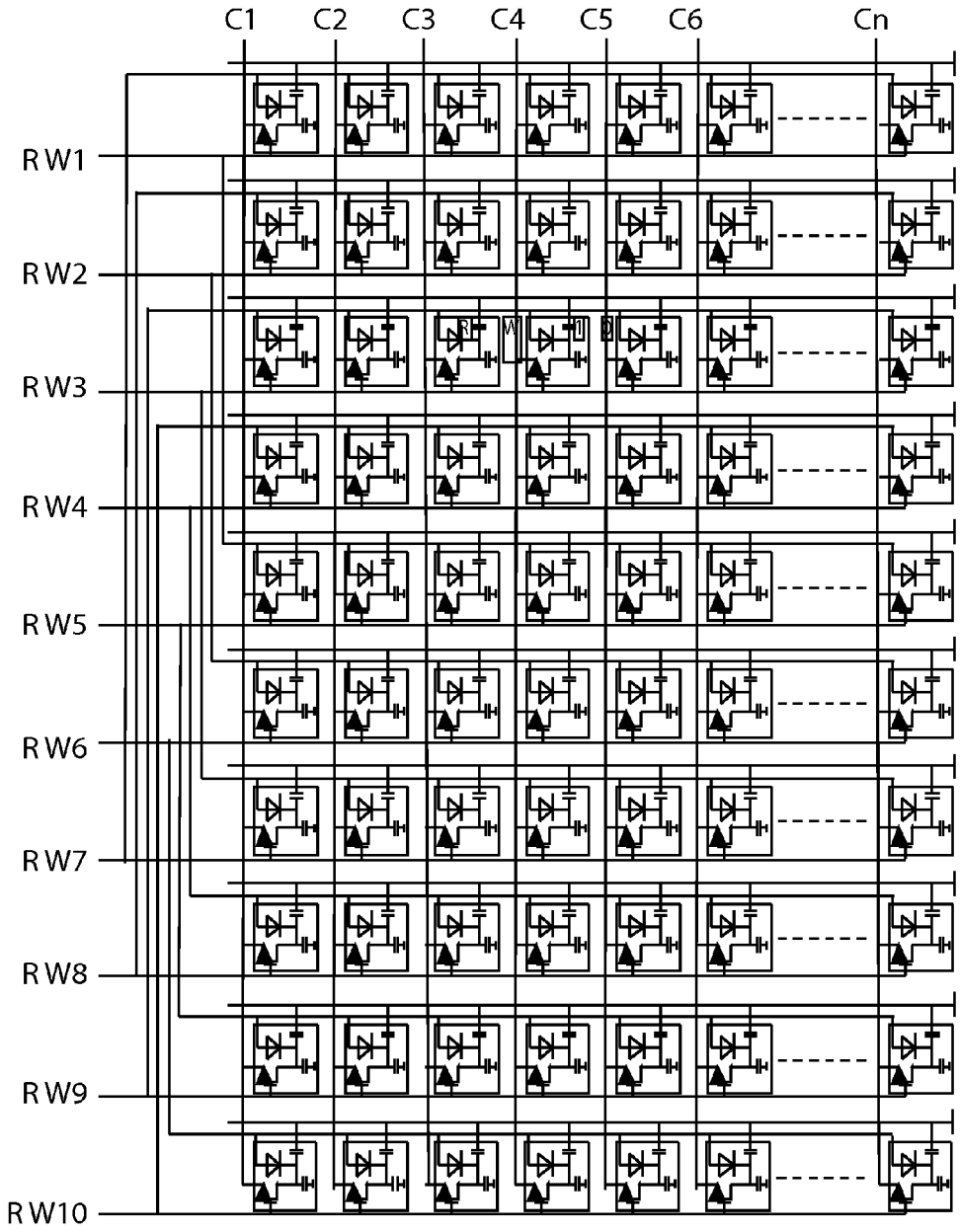
FIG. 7 shows an embodiment of the device according to the invention.

FIG. 7 demonstrates a working example of a device according to an embodiment of the invention. In this example, the row selection time is 10 μs and the necessary reset time is 40 μs, thus the row selection wire is connected to the reset wire of a row located four rows down, since the ratio between the reset time and the row selection time is selected to be four (=40 μs/10 μs). At the start of a frame, the first row is written and simultaneously the fourth row is reset. Next, the second row is written and simultaneously the fifth row is reset. Frame updating proceeds in this manner until the tenth row RW10 is reached, and then a new frame commences. It should be noted that when the last rows are written, pixels in the corresponding rows at the top of the display are reset. In FIG. 7, the timing of the reset pulse is fixed, since the reset wire is hard-wired to the row selection wire.

Figure 8:
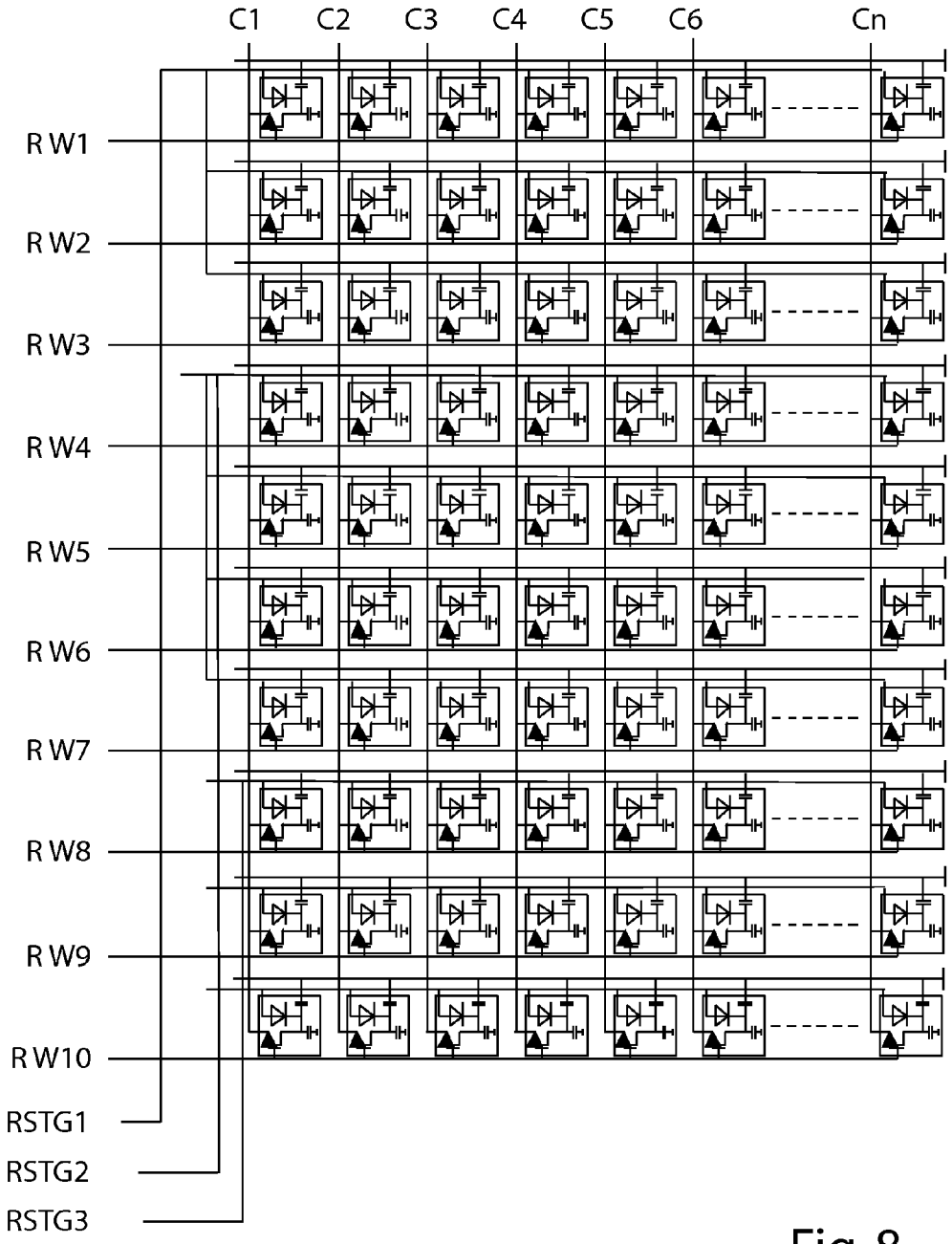
FIG. 8 shows another embodiment of the device according to the invention.

In FIG. 8, there is shown another working example of the device according to another embodiment of the invention. In this example, the display device comprises ten rows (RW1-RW10), wherein a reset wire, being associated with a row, is connected to two or three further reset wires, which are associated with other rows. In total, there are three groups of reset wires RSTG 1, RSTG 2, RSTG 3; two groups RSTG 1, RSTG 3 comprising three rows and one group RSTG 2 comprising four rows. Each group is connected to a separate reset driver. This implementation requires a few additional row drivers, as compared to the previous example. It should be noted that the timing of the reset pulse may be controlled independently of the selection signal. For example, the second reset group RSTG 2 may be reset and data may be written to the rows of the first reset group RSTG 1, then the third reset group RSTG 3 may be reset and data may be written to the rows of the second reset group RSTG 2, and so forth. Moreover, in line with the embodiment of FIG. 7, some or all additional reset drivers may be eliminated by means of connecting the reset groups wires to a respective, appropriate selection wire.

Even though the invention has been described with reference to specific exemplifying embodiments thereof, many different alterations, modifications and the like will become apparent for those skilled in the art. The described exemplifying embodiments are therefore not intended to limit the scope of the invention, as defined by the appended claims.

The invention claimed is:

1. An active matrix display device, comprising:

at least two rows of pixels and selection wires and data wires for addressing the pixels, wherein pixels in each row are arranged with a respective connection to a common reset wire among a plurality of common reset wires arranged to transmit a reset signal, said respective connection being interconnected with the data wire of a pixel when the pixel is addressed, said respective connection being arranged with a signal blocking element for preventing a data signal of the pixel from propagating via the reset wire to pixels in the same row, wherein a transmission of the reset signal is independent of a selection signal, wherein the signal blocking element is a diode, and wherein the display device is an electrowetting display.

2. The display device according to claim 1, wherein said common reset wire among the plurality of common reset wires is connected to the selection wire of another row.

3. The display device according to claim 1, wherein said common reset wire among the plurality of common reset wires is connected to a separate driver.

4. The display device according to claim 1, wherein the device is configured such that while one row of pixels of the at least two rows of pixels is written, another row of the at least two rows of pixels is reset.

5. The display device according to claim 1, wherein the pixel comprises a display element comprising a first electrode, and the display element emits a light corresponding to a signal applied to the first electrode, and an output of the signal blocking element is connected to an output electrode of a transistor connected to the display element.

6. The display device according to claim 1, wherein the pixel comprises a display element comprising a first electrode, and the display element emits a light corresponding to a signal applied to the first electrode, and an output of the signal blocking element is directly connected to the first electrode.

7. The display device according to claim 1, wherein a first terminal of the diode is directly connected to a first electrode of the pixel, the pixel comprising the first electrode, a second electrode, and a first liquid and a second liquid disposed between the first electrode and the second electrode.

8. The display device according to claim 1, wherein several common reset wires are arranged in groups and interconnected with each other, such that each group is controllable by a common reset signal.

9. The display device according to claim 8, wherein said several common reset wires in said groups are connected to a common wire, which is connected to a selection wire of another row.

10. The display device according to claim 8, wherein said several common reset wires in said groups are connected to a common wire, which is connected to a separate row driver.

* * * * *

UNITED STATES PATENT AND TRADEMARK OFFICE

CERTIFICATE OF CORRECTION

PATENT NO. : 8,390,545 B2
APPLICATION NO. : 12/091175
DATED : March 5, 2013
INVENTOR(S) : Van Den Biggelaar et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 874 days.

Signed and Sealed this
Eighteenth Day of November, 2014

Michelle K. Lee

Michelle K. Lee
*Deputy Director of the United States Patent and Trademark Office*